US008985322B2

(12) United States Patent
Cullison

(10) Patent No.: US 8,985,322 B2
(45) Date of Patent: Mar. 24, 2015

(54) PACKAGING WITH AFFIXED SORBENT SACHET

(75) Inventor: Virginia Garner Cullison, Bonita Springs, FL (US)

(73) Assignee: Multisorb Technologies, Inc., Buffalo, NY (US)

( * ) Notice: Subject to any disclaimer, the term of this patent is extended or adjusted under 35 U.S.C. 154(b) by 205 days.

(21) Appl. No.: 13/325,955

(22) Filed: Dec. 14, 2011

(65) Prior Publication Data

US 2013/0153445 A1 Jun. 20, 2013

(51) Int. Cl.
*B65D 81/26* (2006.01)
*B65B 55/20* (2006.01)
*B65D 75/42* (2006.01)

(52) U.S. Cl.
CPC ..... *B65D 81/268* (2013.01); *B65B 55/20* (2013.01); *B65D 75/42* (2013.01)
USPC ..... 206/204; 383/38; 383/40

(58) Field of Classification Search
CPC ..... B65D 81/268
USPC ..... 206/522, 204, 524.1, 524.4, 484; 383/38, 37, 40
See application file for complete search history.

(56) References Cited

U.S. PATENT DOCUMENTS

| | | | | |
|---|---|---|---|---|
| 4,657,133 | A * | 4/1987 | Komatsu et al. | 206/204 |
| 4,965,986 | A | 10/1990 | Klinkel | |
| 6,089,367 | A * | 7/2000 | Anderson et al. | 206/204 |
| 6,829,876 | B1 | 12/2004 | Young et al. | |
| 2008/0178559 | A1 | 7/2008 | DeFedericis | |
| 2009/0223839 | A1 | 9/2009 | DeFedericis | |

FOREIGN PATENT DOCUMENTS

| | | | | |
|---|---|---|---|---|
| JP | 03200556 | A * | 9/1991 | B65D 75/12 |
| JP | 04128161 | A * | 4/1992 | B65D 81/18 |
| JP | 2005-186507 | A | 7/2005 | |

OTHER PUBLICATIONS

PCT Notification of Transmittal of the International Search Report and the Written Opinion of the International Searching Authority, or the Declaration, dated Apr. 22, 2013 (2 pages).
PCT International Search Report, dated Apr. 22, 2013 (4 pages).
PCT Written Opinion of the International Searching Authority, or the Declaration, dated Apr. 22, 2013 (5 pages).

* cited by examiner

*Primary Examiner* — David Fidei
(74) *Attorney, Agent, or Firm* — Lee & Hayes, PLLC

(57) ABSTRACT

A sorbent container includes a plurality of sealed pockets connected in a strip. At least one of the pockets is a filled pocket containing a quantity of sorbent material. A pocket adjacent to the filled pocket is empty.

20 Claims, 7 Drawing Sheets

PACKAGING WITH AFFIXED SORBENT SACHET

BACKGROUND OF THE INVENTION

1. Field of the Invention

This invention relates generally to packaging. More specifically, the invention relates to packaging with an integrated sorbent sachet.

2. Description of Related Art

Sorbents and especially desiccants have been provided to customers as sachets or packets connected as strips or bandoliers for many years. Automated high speed machines and methods for manufacturing such products are relatively well-known and a number of companies offer such products to the trade. Large strips of packets are available with packets numbering up to 10,000 or 15,000 available in a continuous form.

Sachets conventionally absorb moisture, oxygen, odor, or other volatiles from products/product packaging to extend the shelf life and potency of the product, so the packet for the sorbent is usually porous or permeable to moisture, volatiles, odorants, and the like. While a number of materials have been used over the years to provide the combination of strength and porosity or permeability required for the products, non-woven materials, such as those commercially available under the trade name TYVEX® are especially popular. Non-woven's are both strong and porous and automated methods for the manufacture and insertion of packets made from non-woven materials have been developed by a number of competitors in this field.

The strips of packets are conventionally used by separating the packets and inserting a single packet into product packaging. This may be done manually, but in many applications the packets are automatically separated and inserted into the product packaging.

One drawback of using "loose" packets in product packaging is that the packet will inevitably comingle with the product. In some instances, like where the product has its own wrapping, this may be no problem, but in instances where the product is not itself wrapped, for example when the product is a loose granular or powdered product, a user may not think to separate the sorbet packet, inadvertently keeping the packet with the product after removal from the packaging, potentially leading to unintentional consumption, when the granular or powdered product is intended for human consumption. Requiring a user of the product to account for the packet is unacceptable for some product providers, so such providers have conventionally sought after and implemented sorbent solutions different from sachets.

Thus, there is a need in the art for a sorbent sachet product that need not be accounted for by a user.

There also is a need in the art for such a sachet product that is readily manufactured using standard equipment.

There also is a need in the art for an improved method of packaging products in containers having an affixed sachet that will remain in the container after the product in the container is removed.

BRIEF SUMMARY OF THE INVENTION

This invention remedies deficiencies in the conventional art, such as those mentioned above, by providing improvements in packaging using sorbent packages.

In one aspect of the invention, a desiccant includes a plurality of sealed pockets connected in a strip. At least one of the pockets is a filled pocket containing a quantity of sorbent material. A pocket adjacent to the filled pocket is empty. In use, the empty packet is fixed to the inside of a container storing product.

In another aspect, a package includes a sealable container having an interior surface defining a space for receiving a product and a strip of a plurality of connected fillable sealed pockets disposed in the space. At least one of the pockets is a filled pocket, containing a sorbent material, and at least one of the pockets is an empty pocket, substantially devoid of the sorbent material. The empty pocket is fixed to the interior surface of the container.

An understanding of these and other aspects, features, and benefits of the invention may be had with reference to the attached figures and following disclosure, in which preferred embodiments of the invention are illustrated and described.

BRIEF DESCRIPTION OF THE SEVERAL VIEWS OF THE DRAWING(S)

While the novel aspects of the invention are set forth with particularity in the appended claims, the invention itself together with further objects and advantages thereof may be more readily comprehended by reference to the following detailed description of the invention taken in conjunction with the following drawings in which:

DETAILED DESCRIPTION OF THE INVENTION

Figure 1:
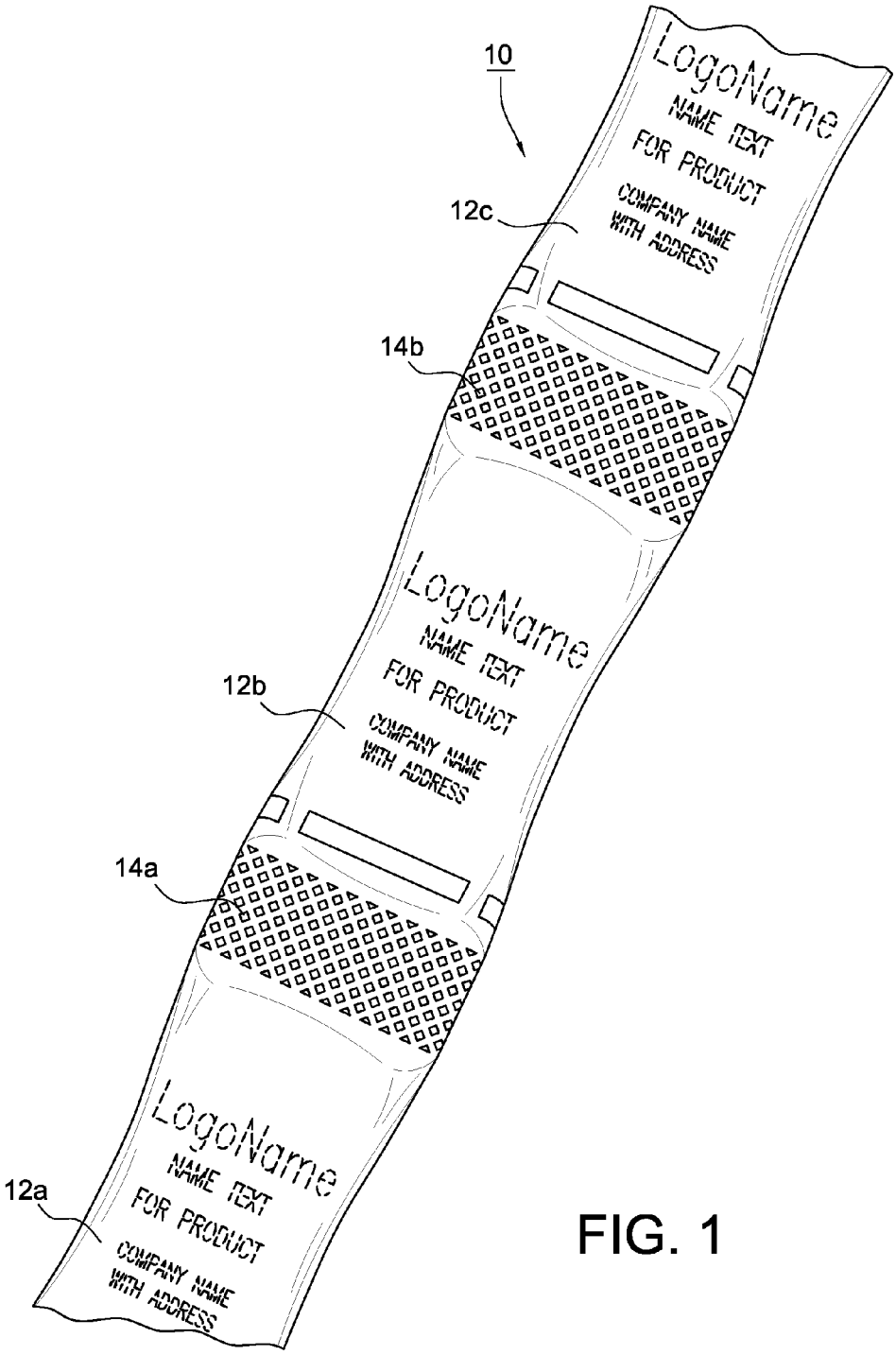
FIG. 1 is a perspective view of a portion of a strip of sorbent packages in accordance with this invention.

Referring now to FIG. 1, a portion of a strip 10 of sorbent packages in accordance with this invention is illustrated in diagrammatic form. While portions of three packages are shown, a larger or smaller number of packages may be provided in a continuous strip. For example, as many as 10,000 or 15,000 packages may be included per strip. For ease of handling, the packages preferably are rolled on to a spool and delivered to customers in a continuous strip. As noted, the invention generally relates to the use of sorbents in packaging. As used herein, sorbent may indicate any material that is capable of affecting a change to environs in which the sorbent is placed. Sorbents can include, but are not limited to, desiccants, oxygen absorbers, volatile absorbers, acid-gas absorbers, humectants, activated carbon, and combinations thereof.

The portion of the strip 10 shown in FIG. 1 includes three packets 12*a*, 12*b*, 12*c* all having generally the same construction. As will be described in more detail below, a continuous web of packet material is used to form the packets as a continuous, connected number of sealed packets. Referring to the central packet 12*b*, first and second lateral seals 14*a*, 14*b*, which preferably are ultrasonically welded seals, extend laterally across the strip 10 to seal the common ends of packets 12*a* and 12*b* and 12*b* and 12*c*, respectively. The lateral seals 14*a*, 14*b* extend over a predetermined (longitudinal) length of the strip of packets. Preferably, each lateral seal is long enough in the longitudinal direction of the strip 10 to permit the sealing area to be cut proximate its middle to separate adjoining individual packets 12*a*, 12*b*, 12*c*, while both remain sealed. The illustrated lateral seals are cross-hatched seals formed either from continuous cross-hatched sealing lines or, more preferably, from an array of sealing points which may be round, square, diamond shape or any other convenient shape, arranged in a grid of intersecting rows that form a generally cross-hatched pattern. The cross-hatched pattern largely prevents fraying when the packages are cut apart while at the same time not forming points or lined points or line weakness that may allow the sorbent within the package to escape. Although the illustrated lateral seals are cross-hatched, any sealing arrangement that maintains the packets sealed and separate from each other may be used. Although the illustrated lateral seals are formed from ultrasonic welding, such is not required. The welds may be formed in any conventional manner, including but not limited to adhesives, fasteners, welding, heat sealing, and impulse sealing.

Figure 2:
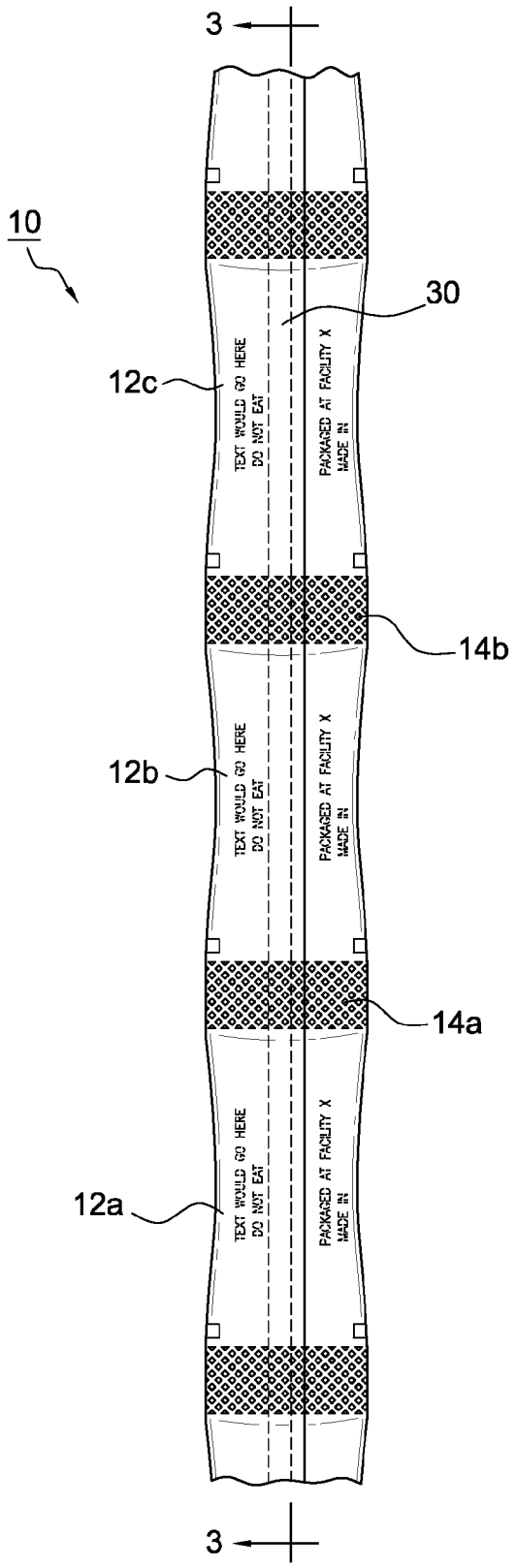
FIG. 2 is a plan view of the backside of the sorbent packages of FIG. 1.

In FIG. 2, the packets 12*a*, 12*b*, 12*c* are shown from the opposite side. As will be described in more detail below, a longitudinal seal 30 is made on an overlapping portion of the edges of the packaging material to form an elongated tubular structure. Preferably, the seal 30 is formed by welding and more preferably by welding a portion, but not the entirety of the overlapping edges of the packet material together. Preferably, when a non-woven polyolefin is employed as the packet material, the welding process renders the welded portion wholly or partly transparent or at least translucent so that the contents of the packets may be seen through the welded portion of the package. Furthermore, when the lateral seal 14 is formed, preferably after the longitudinal seal 30 is formed, the seal is formed across the entirety of the packet and the thickest portion thereof, that is, the portion including the longitudinal seal 30 where the edges overlap, is rendered transparent or at least translucent by the welding process.

Figure 3:
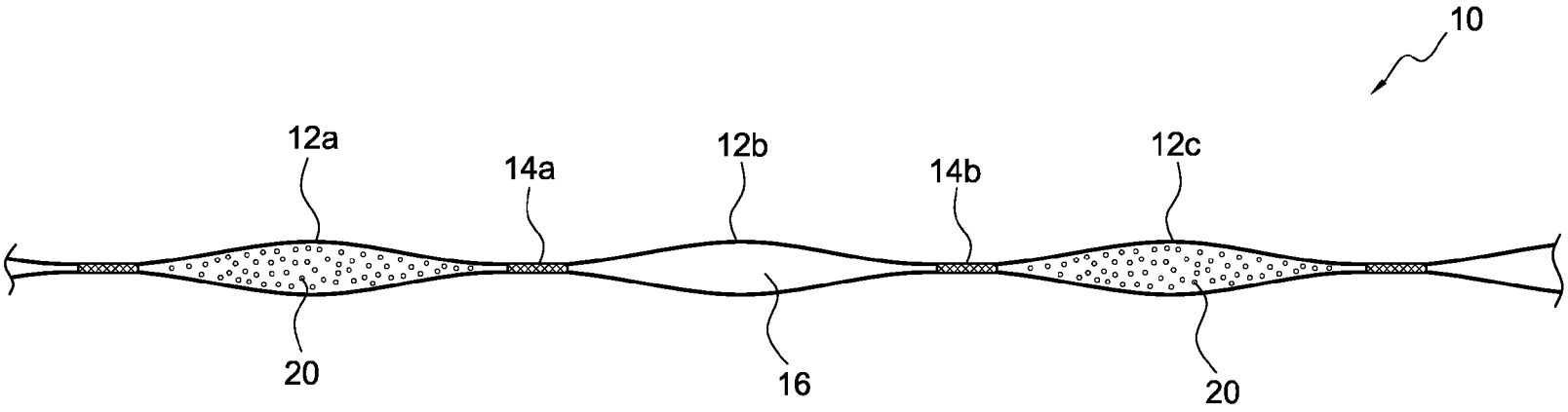
FIG. 3 is a cross-sectional view of the strip of sorbent packages of FIGS. 1 and 2, taken along line 3-3 in FIG. 2.

FIG. 3 is a cross section of the strip 10 of packets illustrated in FIGS. 1 and 2, taken along section line 3-3 in FIG. 1. As illustrated, each of the packets defines an enclosed pocket 16 bounded generally by the packet web and the lateral seals, e.g., lateral seals 14*a*, 14*b*, on longitudinal ends. As also illustrated in FIG. 3, the pockets 16 formed by packets 12*a*, 12*c* contain a sorbent material 20, so packets 12*a* and 12*c* are filled packets. The pocket 16 formed by packet 12*b* is empty, thus packet 12*b* is an empty packet, devoid of the sorbent material 20.

In the illustrated embodiment, the packets 12*a*, 12*b*, 12*c* are substantially identical to each other, but for some being filled and some being empty. The illustrated embodiment shows alternating full and empty packets, but other patterns also may be provided, as will be appreciated from the following description.

Figure 4:
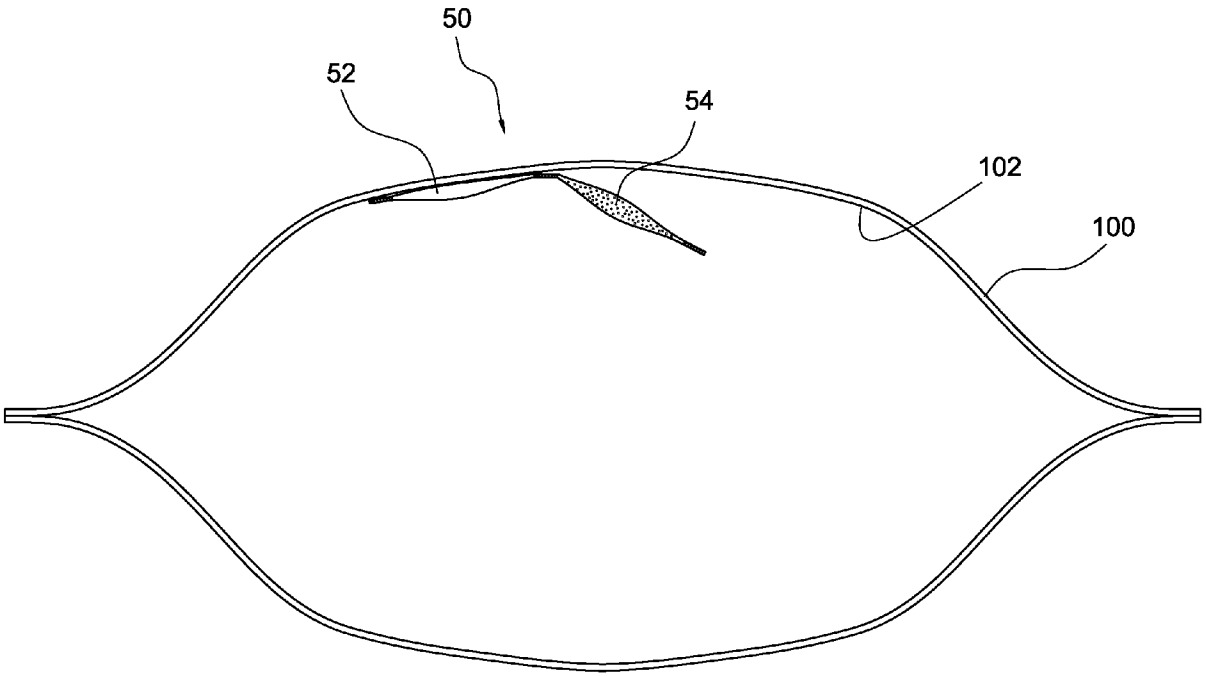
FIG. 4 is a cross-sectional view of a package containing a strip of sorbent packages according to an embodiment.

Unlike some conventional uses where the packets are separated at each lateral seal to provide single packets that are subsequently inserted into product packaging, the packets of the present invention are intended to be used as a strip including two or more packets. Of the two or more packets, at least one is a filled packet and at least one is empty. As illustrated in FIG. 4, a strip 50 of two packets, one empty packet 52 and one filled packet 54, is provided in a container 100. The empty packet 52 provides a point of attachment for affixing the strip 50 to an inside surface 102 of a container 100. Thus, the sorbent is disposed within the container to modify the atmosphere in the container, e.g., by absorbing moisture, oxygen, or the like, but the risk of the sorbent inadvertently leaving the container upon removing the contents of the container is substantially eliminated. Thus, when food products are stored in the container, the risk of a sachet being ingested inadvertently by a user is lessened. Moreover, when surgical devices are packaged in the container, a surgeon need not account for a separate sachet.

The empty packet 52 may be affixed to the container using any known method such as adhesion, welding, heat sealing, ultrasonic sealing or welding, impulse sealing, and fasteners. In the illustrated embodiment of FIG. 4, the container 100 is a polymeric bag and the empty packet 52 is ultrasonically welded or heat sealed to the inside surface 102.

Using the empty packet 52 for affixation provides many benefits. For example, the relatively large size of the packet allows for ample space to affix the strip 50 to the container 52. Moreover, there is no need to physically modify conventional machinery for making strips of sachets. Such machinery 200 is shown in FIG. 5, and its operation will be discussed now.

To make a strip of packets, a web 202 of non-woven material as long or longer than the desired length of the strip of sachets is provided to the machinery 200. While the web may be made from a variety of materials depending upon the nature of the sorbent enclosed within the packet, non-woven materials, more preferably non-woven, spun bonded polyester materials such as Tyvek spun bonded non-woven polyester manufactured by DuPont are used. Heat sealable Tyvek materials or otherwise coated Tyvek-materials may also be used. Generally, the web may be any single-ply or multi-laminated structure that is permeable and/or porous to allow passage of the material to be absorbed by the sorbent therethrough. In the illustrated embodiment, the web 202 is provided from a spool 204 although it may be provided as a continuous feed from any manner of supply. The filling machinery 200, using conventional drivers, rollers, and appropriate processing equipment, feeds the web 202 from the supply to a mandrill 206 about which the web 202 is rolled. Once rolled, a heat sealer, provided in FIG. 5 as a roller 208, contacts the rolled web 202 at a sealing position 210 to form a continuous or intermittent longitudinal seal. The seal may be formed by overlapping the edges of the web 202 or forming a fin by sealing facing edges of the web 202 together. Thus, the mandrill 206 and heat sealer 208 cooperate to form the web into a continuous tube of material. Although the longitudinal seal is illustrated as being formed by a heat sealer, it may be formed using any conventional method and machine. By way of non-limiting example, the longitudinal seal may alternatively be formed by welding, such as ultrasonic welding, adhesion, or impulse sealing.

The tube is passed to a welding station 212, which may be an ultrasonic welding station including a welding bar. Sorbent 20, preferably desiccant, is dispensed in predetermined quantities into the packets as the lateral seal forms. The web is then further indexed and a second lateral seal is formed to seal the sorbent 20 in the packet. The process is repeated until the length of packaging material is exhausted or until the desired number of packets has been formed. A take-up reel 214 may be provided for spooling the formed packets.

Figure 5:
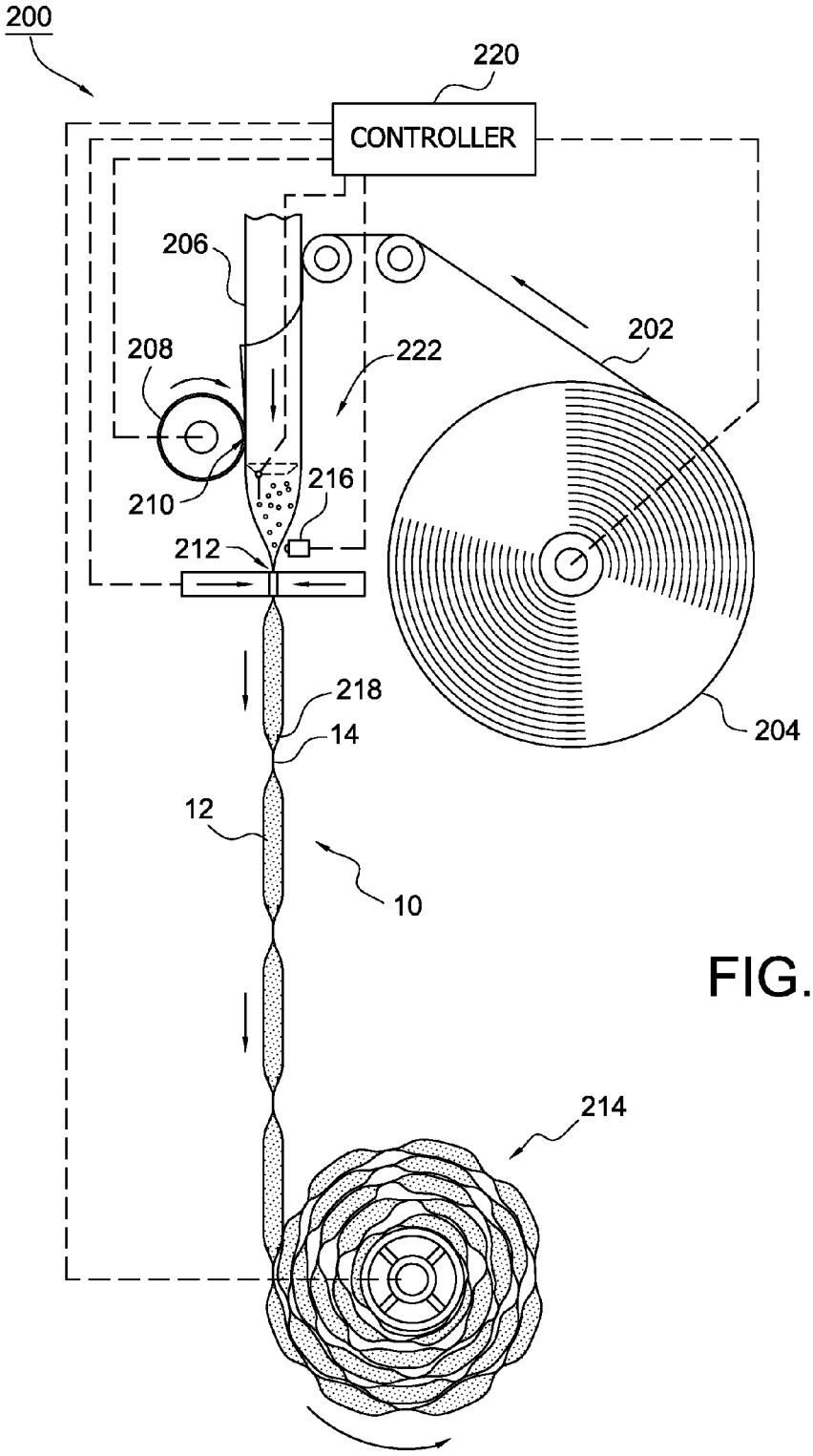
FIG. 5 is a schematic representation of a machine for forming and filling the strip of packages shown in FIG. 1.

In FIG. 5, a sensor 216 also is provided, to detect registration marks 218 pre-printed or otherwise formed on the web 202. The sensor 216 and registration marks 218 are operatively used to ensure correct sizing of the packets, i.e., by cooperating with the welding station 212 to form a lateral seal only at predetermined positions along the web 202. In alternative embodiments, the sensor 216 and the registration marks 218 are not used, the spacing instead being determined by some alternative means, such as timing or measuring means.

As also illustrated in FIG. 5, a controller 220 is provided in communication with the supply 204, the heat seal roller 208, the welding station 212, the take-up reel 214, and the sensor 216 to coordinate manufacture of the packets. According to the invention, the controller 220 also controls a sorbent dispenser 222, which in the illustrated embodiment is contained in the mandrill 206. Conventionally, the controller 220 would control the dispenser 222 to dispense a predetermined quantity of sorbent each time a lateral seal is formed. In the present invention, however, the controller 220 controls the dispenser 222 to selectively fill the packets 12. In the illustrated embodiment, every other sachet is filled with a predetermined amount of desiccant.

The technique just described has been used for packages formed by heat and pressure on adhesive coated non-woven materials as well as for packages formed by ultrasonic seals formed on raw non-woven materials.

The filled and empty packets are substantially identical in size and shape, the lone difference being the contents. In this manner only a programming change need be made to existing machinery, i.e., to selectively fill the packets instead of filling all packets, to obtain a strip of packets adapted for affixation to the inside of the container. In other embodiments the empty packets could be longitudinally shorter than the filled packets. This could be achieved by selectively varying the position of the registration marks 242 longitudinally along the web 202 or by controlling the timing of formation of the lateral seals when no registration marks are used.

In use, the take-up reel 214 is provided to a packer that unspools the strip of packages and cuts the packages into smaller strips for use. Conventionally, the packer would employ packaging machinery that would cut the strip at each lateral seal to provide single packets, but in the present invention, the strips are cut into smaller strips of at least two packets, one empty and one filled with a desiccant. The smaller strip is then fixed to an inner surface of a container by affixing the empty packet to the container.

The affixation of the strips to the container may be done manually or automatically, and it may be done at any stage of the packaging process. For example, a user may receive the strip of packets including the empty and the filled pockets and manually affix the empty pocket to an inside of the container, for example, using an adhesive or a welding mechanism. The affixation technique may be dictated depending upon the materials used for the container and the packets. For example, ultrasonic welding has been found to be effective when both the container and the packet are made of non-woven fabrics.

Although the user will readily tactually identify the empty packet to be affixed to the container, a visible indication could be provided in addition. In other embodiments, each empty packet could have an adhesive disposed thereon, which is subsequently covered with a peelable barrier layer. The user removes the peelable barrier layer to expose the adhesive, which is then used to affix the strip to the container. One of ordinary skill in the art can select an adhesive depending upon the materials used for the packets and the container.

In yet another embodiment, the empty packet is fixed to the container prior to formation of the container. For example, polymeric containers, such as bags, are often formed from webs of the polymeric material. The strip could be fixed to the web prior to forming the polymeric container.

Figure 6:
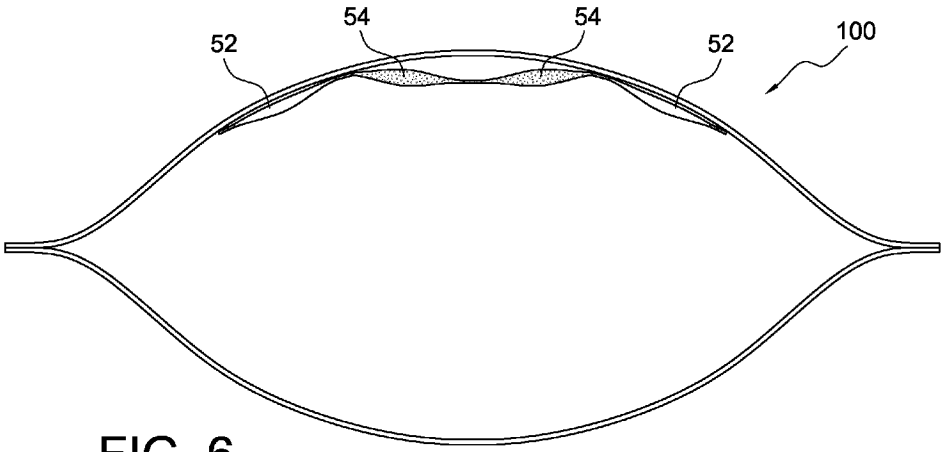
FIG. 6 is a cross-sectional view of a package containing a strip of sorbent packages according to another embodiment of the invention.

Although embodiments discussed above describe inserting strips containing two packets, one filled and one empty, into product containers, more packets could be provided. For example, additional filled packets could be provided to increase the amount of sorbent in the container. Additional empty packets also could be provided, each providing a point of attachment for the strip. Thus, for example, two empty packets could sandwich therebetween one or more filled packets. Preferably, the empty packets are both fixed to the interior surface of the container, at different positions, as shown in FIG. 6. In this manner, the filled packets are not freely hanging in the container.

Figure 7:
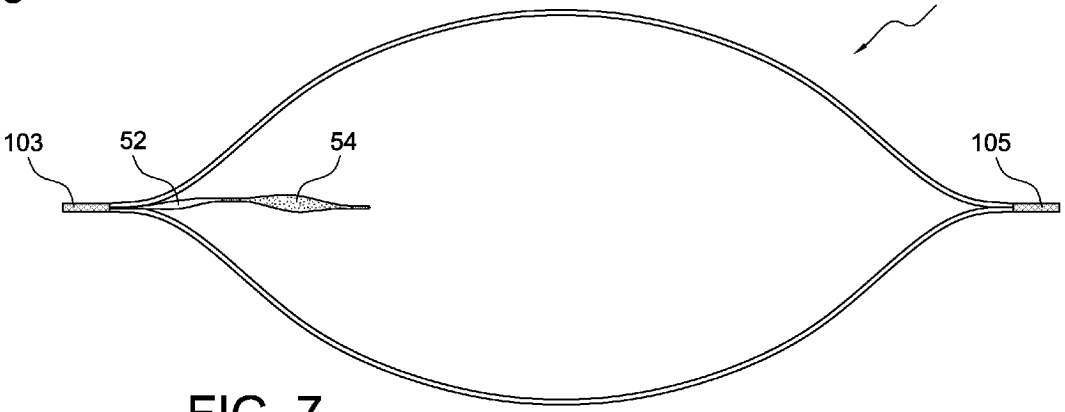
FIG. 7 is a cross-sectional view of a package containing a strip of sorbent packages according to another embodiment of the invention.

In one embodiment, as illustrated in FIG. 4, the empty packet is affixed to the inside of the container spaced from the seals of the container. In this manner there is no chance that the process of affixing the sorbent strip to the container compromises the container seals. The empty pocket may be ultrasonically welded to the container. In another embodiment, the empty packet may be sealed into a seal of the container. When the container is sealed after the product is placed in it, the empty packet is disposed such that creation of the seal ultimately closing the packet will also affix the sorbent strip to the container, in the closing seal. Such an embodiment is illustrated in FIG. 7. There, the container 100 has two end seals 103, 105. The empty pocket of the sorbent strip is captured, and thereby integrated, into one of those seals 103, 105, and the filled container is disposed in the container. Preferably, the user will open the container at a position spaced from the seal integrating the empty pocket. For example, the user may be instructed to open the package at seal 105 when the packet is retained in seal 103.

Figure 8:
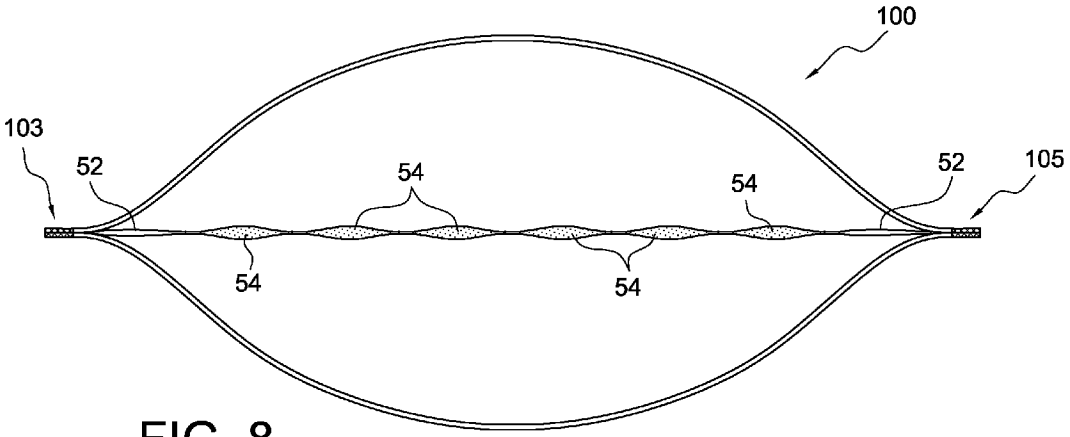
FIG. 8 is a cross-sectional view of a package containing a strip of sorbent packages according to another embodiment of the invention.

FIG. 8 illustrates another embodiment of the invention. There, a strip of packets includes empty pockets on opposite ends of the strip with filled pockets therebetween. Like in FIG. 7, the container 100 has two end seals 103, 105, and one of the empty pockets at one end of the strip is sealed into one of the end seals 103, 105. In this embodiment, though, an empty pocket is provided at the opposite end of the strip, and that empty pocket is sealed into the other of the end seals 103, 105. Thus, the strip extends between the end seals 103, 105 of the container 100.

Figure 9:
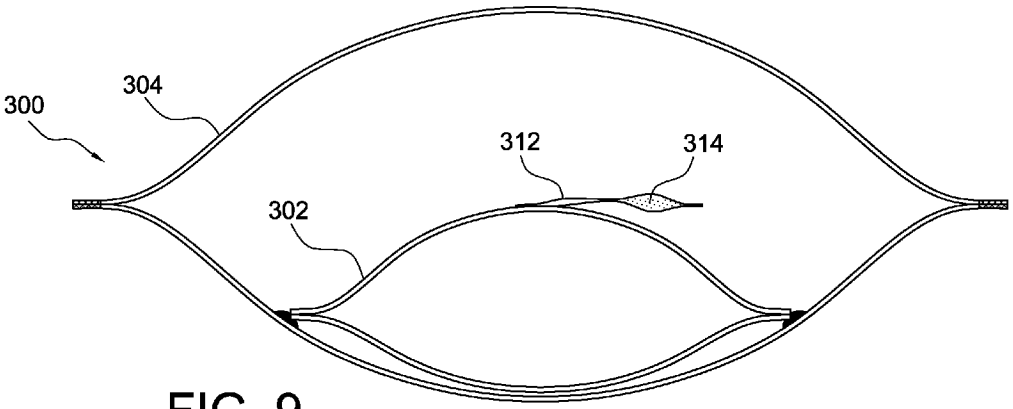
FIG. 9 is a cross-sectional view of a package containing a strip of sorbent packages according to still another embodiment of the invention.

Yet another embodiment of the invention is shown in FIG. 9. There, a strip of packets like those discussed above is used in conjunction with packaging 300 that includes inner and outer packages 302, 304, such as inner and outer bags. In this embodiment, an empty pocket 314 of a strip of pockets 310 that includes filled and empty pockets 312, 314 is affixed to an outside surface of the inner package 302, which is then disposed in the outer package 304. The outer package 304 is preferably a hermetically sealed package, impervious to oxygen and/or moisture, whereas the inner package 304 is preferably oxygen and/or moisture permeable.

While the invention has been described in connection with several presently preferred embodiments thereof, those skilled in the art will appreciate that many modifications and changes may be made therein without departing from the true spirit and scope of the invention which accordingly is intended to be defined solely by the appended claims.

The invention claimed is:

1. A package comprising:

a sealable container having an interior surface defining a space for receiving a product; and a strip comprising a plurality of connected fillable sealed pockets disposed in the space, at least one of the pockets being a filled pocket, filled with a sorbent material, and at least one of the pockets being an empty pocket that is substantially devoid of the sorbent material, is fixed to the interior surface in the container, shares a common seal with the filled pocket, and extends from the seal in a first longitudinal direction defined by the strip, and the filled pocket extends from the seal in a second longitudinal direction defined by the strip opposite the first longitudinal direction.

2. The package of claim 1, wherein the empty pocket is one of ultrasonically welded and impulse sealed to the surface in the container.

3. The package of claim 1, wherein the empty pocket is located adjacent the filled pocket.

4. The package of claim 1, wherein the empty pocket is spaced from the filled pocket by one of a second empty pocket and a second filled pocket.

5. The package of claim 1, wherein the empty pocket comprises a first empty pocket, the package further comprising a second empty pocket spaced from the first empty pocket by at least the filled pocket.

6. The package of claim 5, wherein the second empty pocket is fixed to the interior surface of the container.

7. The package of claim 6, wherein the second empty pocket is fixed to the interior surface of the container at a position spaced from a position at which the first empty pocket is fixed to the interior surface of the container.

8. The package of claim 1, wherein the sealable container is a pouch formed from facing webs of material sealed about a periphery by a peripheral seal.

9. The package of claim 8, wherein the empty pocket is fixed to the interior surface by being disposed between the facing webs of material at the peripheral seal.

10. The package of claim 8, wherein the empty pocket is sealed to one of the facing webs of material at a position spaced from the peripheral seal.

11. The package of claim 8, wherein the empty pocket is fixed to an outer surface of an interior package containing the product.

12. The package of claim 1, wherein the sorbent is one of a desiccant, an oxygen absorber, a volatile absorber and an acid and gas absorber.

13. A method of packaging a product in the package of claim 1 comprising steps of:

providing the sealable container as an open container;

providing the strip of connected fillable sealed pockets, including the at least one filled pocket, filled with the sorbent, and the at least one an empty pocket;

fixing the empty pocket to an inside of the container; and placing a product in the container.

14. The method of claim 13, further comprising:

sealing the container about the product.

15. The method of claim 13, wherein the fixing step comprises ultrasonically welding the empty pocket to the inside of the container.

16. The method of claim 13, wherein the fixing step comprises impulse sealing the empty pocket to the inside of the container.

17. The method of claim 13, wherein the strip of connected pockets comprises a second empty pocket, spaced longitudinally along the strip from the empty pocket by at least the filled pocket, the method further comprising fixing the second empty pocket to the inside of the container.

18. The method of claim 17, wherein the second empty pocket is fixed to inside of the container at a position spaced from a position at which the empty pocket is fixed to the inside of the container.

19. The package of claim 1, wherein the filled pocket has a first size, and the empty pocket has a second size substantially identical to the first size.

20. The package of claim 1, wherein the strip is formed from a continuous piece of material, and wherein the empty pocket and the filled pocket are formed sequentially along a longitudinal length of the continuous piece of material.

* * * * *